United States Patent [19]

Stultz

[11] Patent Number: 5,042,098

[45] Date of Patent: Aug. 27, 1991

[54] FITTED TOP SHEET WITH PLEAT

[75] Inventor: Doris J. Stultz, Zionsville, Ind.

[73] Assignee: Doris J. Stultz, Noblesville, Ind.

[21] Appl. No.: 346,548

[22] Filed: May 2, 1989

Related U.S. Application Data

[63] Continuation of Ser. No. 8,271, Jan. 29, 1987, abandoned.

[51] Int. Cl.[5] ..... A47G 9/02

[52] U.S. Cl. ..... 5/495; 5/485; 5/497

[58] Field of Search ..... 5/482, 485, 495, 496, 5/497, 498

[56] References Cited

U.S. PATENT DOCUMENTS

| | | | |
|---|---|---|---|
| 2,603,798 | 7/1952 | Crescenzi | 5/497 |
| 2,679,056 | 5/1954 | Simpson | 5/485 |
| 2,695,414 | 11/1954 | Ford et al. | 5/485 |
| 2,772,425 | 12/1956 | Brodie | 5/485 |
| 2,788,532 | 4/1957 | Christley | 5/497 |
| 3,254,348 | 6/1966 | Di Addario | 5/497 |
| 3,654,646 | 4/1972 | McMahon, Jr. | 5/485 |
| 4,021,869 | 5/1977 | Root | 5/497 |
| 4,197,601 | 4/1980 | Maguire | 5/497 |
| 4,308,626 | 1/1982 | Weiss | 5/485 |
| 4,316,299 | 2/1982 | Friedman | 5/497 |

*Primary Examiner*—Eric K. Nicholson
*Attorney, Agent, or Firm*—Woodard, Emhardt, Naughton, Moriarty & McNett

[57] ABSTRACT

A fitted top sheet with a pleat across the foot end thereof to provide room for a user's feet when placed on a mattress. The fitted sheet is of one piece construction with the space being provided by cutting a generally square section out of two adjacent corners at a narrow end of a generally rectangular sheet, folding a portion of the sheet toward the cut edges on the longer side of the sheet parallel thereto, folding the cut edges at each corner and the adjoining folded edges at right angles to the main sheet surface into overlapping contact with each other at each corner, securing the cut edges and folds of the longer sheet side with the cut edge of the sheet end on each corner by sewing or similar means, seaming the end of the fold spaced away from the cut edge along the side surface of the sheet at right angles to the long edge of the sheet, and placing an elastic material along the outer edge of the folded end and extending along each of the side edges to the seam at the fold spaced apart from the cut edge to form a fitted end when placed around a mattress.

4 Claims, 2 Drawing Sheets

EXHIBIT
A

FITTED TOP SHEET WITH PLEAT

This application is a continuation of application Ser. No. 008,271, filed Jan. 29, 1987, now abandoned.

BACKGROUND OF THE INVENTION

1. Field of the Invention

The subject invention relates to a fitted top sheet for beds, and in particular, to a fitted top sheet which provides a pleat across the foot portion thereof to provide space for a user's feet beneath the sheet.

2. Description of the Prior Art

One problem presented by the use of fitted top sheets on beds is that no space is provided for the user's feet beneath the sheet. Numerous patents have attempted to remedy the problem by providing sheet constructions and devices to provide space below the sheet for the user's feet. Close fitting top sheets result in making the sheet uncomfortable to the user and, in particular, to bed ridden patients.

U.S. Pat. No. 2,695,414 provides a top sheet having a larger pocket across the entire width of the bed to provide more foot space for the user.

U.S. Pat. No. 2,772,425 discloses a bed covering which provides additional space for a user's feet at the foot end thereof.

U.S. Pat. No. 4,308,626 also discloses a fitted top sheet that has corners and portions cut from the sheet in a particular configuration following which the sheet is sewn to provide a one piece construction with a fitted bottom corner and foot accomodating space for the user.

Although each of the prior art references attempt to solve the problem of insufficient space for a user's feet in a fitted top sheet, each of the prior art references attempts to solve the problem by providing a complex sheet construction which requires a complex cutting and stitching of the sheet to achieve the desired results.

SUMMARY OF THE INVENTION

It is an object of the present invention to provide a new and improved fitted top sheet which provides space for a user's feet that is simple and inexpensive to manufacture.

It is a still further object of the present invention to provide a fitted top sheet having a pleat across the foot end thereof to provide space for a user's feet that is constructed in a simple, inexpensive manner without requiring complex cutting and material removal patterns as required by the prior art inventions.

These and other objects of the present invention will be seen when reading the description of the preferred embodiment in conjuction with the brief description of the drawings.

DESCRIPTION OF THE PREFERRED EMBODIMENT

Figure 1:
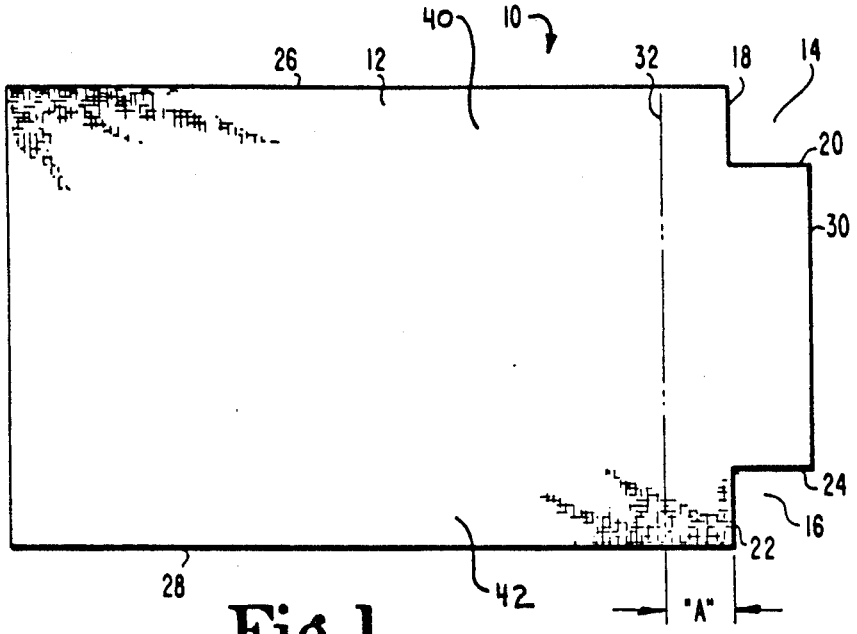
FIG. 1 is a plan view of a top sheet according to the present invention after removal of the two corner pieces.

The preferred embodiment of the subject invention will now be described with reference to the accompanying drawings. As shown in FIG. 1, the fitted top sheet 10 according to the present invention is formed from a single piece of generally rectangularly shaped material 12. Generally square pieces of material are removed from each corner of one end of the piece of material 12 as shown at 14 and 16 by cutting lines 18, 20, 22 and 24. The cuts along lines 18 and 22 are made perpendicularly to the side edges 26 and 28 of the piece of material 12 and are in alignment with each other. The cuts 20 and 24 are made perpendicularly to the end edge 30 of the sheet material 12 and parallel to each other. Each of the cuts 18, 20, 22 and 24 is slightly longer than the thickness of a mattress on which the sheet is to be placed.

Figure 2:
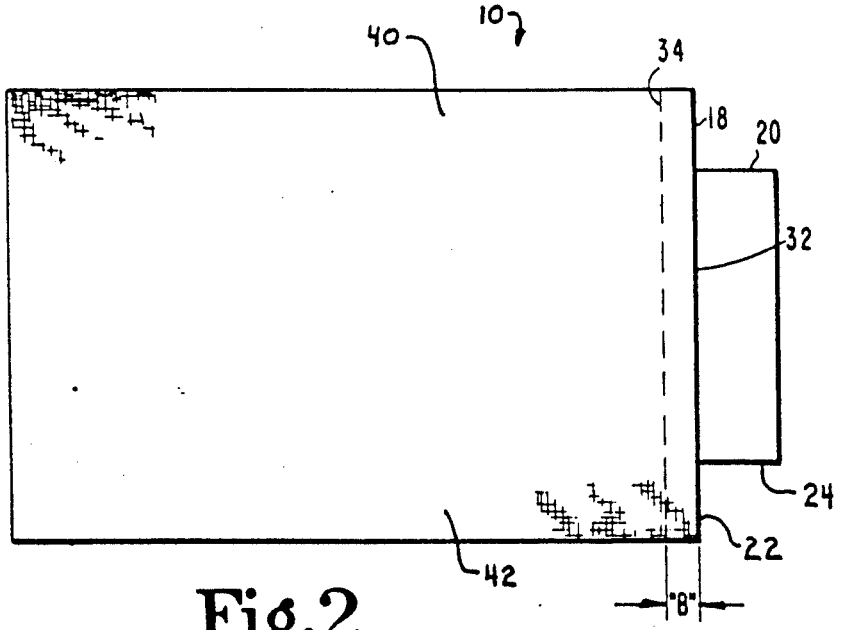
FIG. 2 is a top plan view of a sheet according to the present invention after making the initial fold to form the pleat therein.

A pleat is formed at the foot end of the sheet 10 by folding a portion of the sheet material 12 from a line designated by line 32 at a dimension "A" of approximately eight (8) inches from the side cut lines 18 and 22 forward to and adjacent to the edges formed by cut lines 18 and 22, as shown in FIG. 2. The new dimension "B" is one-half of the original distance "A" shown in FIG. 1. A detail of the pleat made by folding the material designated at line 32 forward to the cut edges 18 and 22 is illustrated in detail in FIG. 3 of the Drawings. The second fold is illustrated at 34 in FIGS. 2 and 3 of the Drawings.

Figure 3:
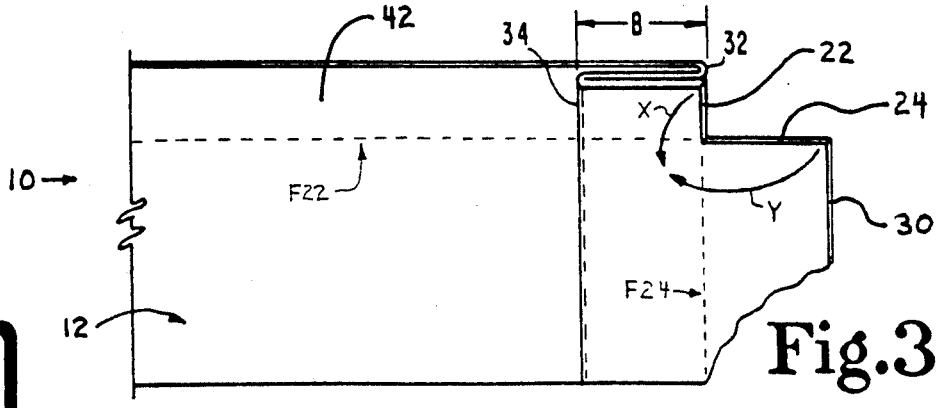
FIG. 3 is a partial section bottom perspective view of a corner of a sheet showing a pleat.
Figure 4:
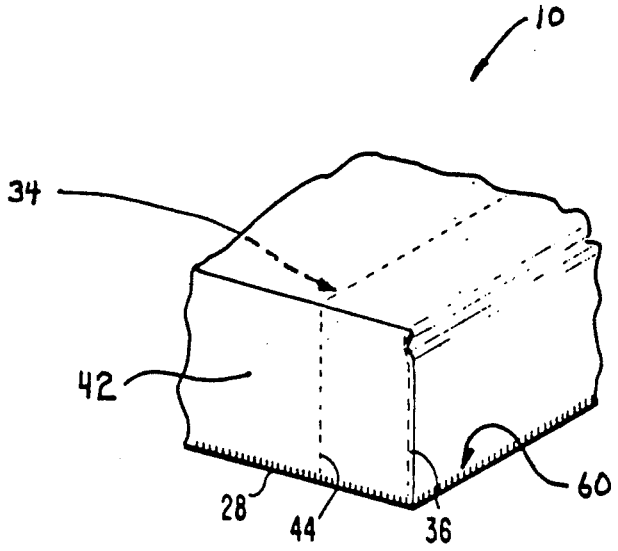
FIG. 4 is a perspective view of a corner of a top sheet in accordance with the present invention; and, FIG. 5 is a perspective view of a bed provided with a top sheet in accordance with the present invention.

As shown in FIGS. 3 and 4 of the Drawings, the cut edge 22 and the corresponding folded edge 32 and the cut edge 24 on the end of the sheet material 12 are folded (see fold F22 and arrow "X", and fold F24 and arrow "Y" shown in FIG. 3) at right angles to the surface of the sheet material 12 to adjoin each other in slightly overlapping relationship to form left corner 36 (see FIG. 4). Similarly, the cut edge 18 and the corresponding fold 32 there along and the cut edge 20 on the opposite side of the end edge 30 are folded at right angles to the surface of sheet material 12 into slightly overlapping relationship with each other to form right corner 38 (see FIG. 5). The corners 36 and 38 are then secured by sewing, glueing, or other suitable securing means.

As shown in FIG. 4, a vertical second seam 44 is sewn forward of and generally parallel to left corner 36 along second fold 34. Second seam 44 is sewn above the side edge 28 on the side portion 42. A similar second seam is likewise provided on the right side forward of right corner 38 along second fold 34.

To complete the sheet, an elastic material 60 (see FIG. 4) or band is placed in or seamed into a hem from just beyond the second seam line 44 around the corner 36 and partially across the end edge 30 of the sheet to form the fitted portion of the sheet 10 to place over the corners of the end of a mattress. The elastic material or band is similarly placed around the opposite corner 38, of the sheet to hold the opposite corner in place.

Figure 5:
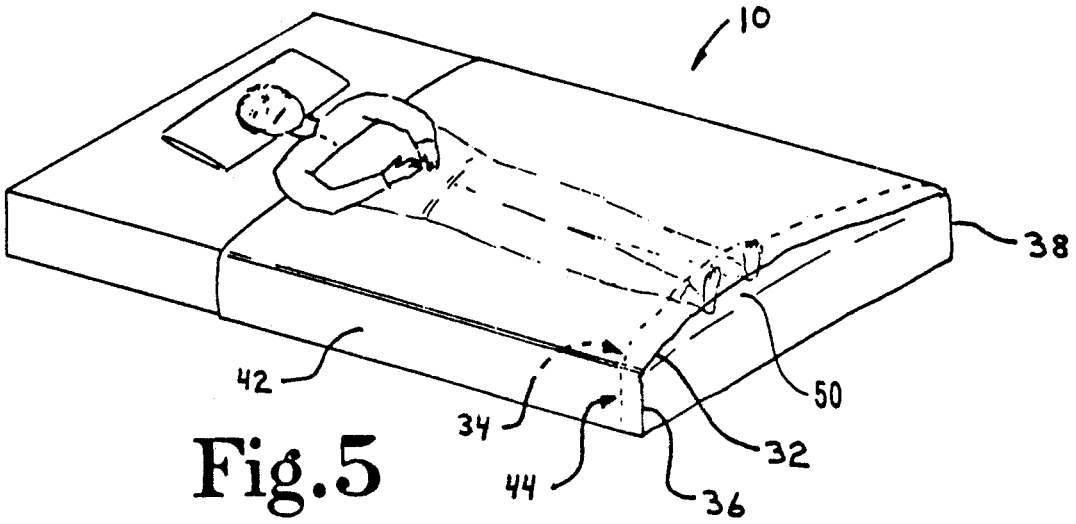

As can be seen by viewing FIG. 5 of the Drawings, the pleat formed by the folded edges 32 and 34 provides a space 50 across the foot end of the sheet for a user's feet.

What is claimed is:

1. A fitted top sheet for a bed for providing room for a user's feet, said sheet comprising a generally rectangular shaped piece of material having a portion of generally square configuration removed from opposite corners of a short side of the rectangular shaped piece of material, the sides of the square portions removed being slightly greater than the thickness of a mattress on which said sheet is to be used, wherein a right side portion and a left side portion are defined along long sides of the rectangular shaped piece of material;

a pleat formed in said rectangular shaped piece of material by folding a portion of the rectangular shaped material toward said short side having the square portions removed at the corners thereof, said folded material defining a first fold in generally adjacent alignment with the edges formed by the removal of said square portions perpendicular to the long sides of the rectangular shaped piece of material and further defining a second fold forward of and generally parallel to said first fold;

said right side portion and said left side portion of the long sides of the rectangular shaped piece of material and said short side from which said square portions of material have been removed each being folded at 90 degrees to a plane surface of the rectangular piece of material to form a left corner and a right corner, said left side portion and said short side being secured together along the length of edges of the sheet formed by one of the removed portions of the material to form said left corner, and said right side portion and said short side being secured together along the length of edges of the sheet formed by the opposite removed portion of the material to form said right corner;

first means for securing a portion of said pleat to said left side portion located forward of said left corner to secure said second fold against unfolding at said left corner; and second means for permanently securing a portion of said pleat to said right side portion located forward of said right corner to secure said second fold against unfolding at said right corner, whereby a folded pleat is formed between said right corner and said left corner to provide space for a user's feet.

2. The fitted sheet as set forth in claim 1, further comprising elastic material permanently secured around said right corner and around said left corner to retain the fitted sheet on a mattress on which said sheet is placed.

3. A fitted top sheet for a bed for providing room for a user's feet, said sheet comprising a generally rectangular shaped piece of material having a portion of generally square configuration removed from opposite corners of a short side of the rectangular shaped piece of material, the sides of the square portions removed being slightly greater than the thickness of a mattress on which said sheet is to be used, wherein a right side portion and a left side portion are defined along long sides of the rectangular shaped piece of material;

a pleat formed in said rectangular shaped piece of material by folding a portion of the rectangular shaped material toward said short side having the square portions removed at the corners thereof, said folded material defining a first fold in generally adjacent alignment with the edges formed by the removal of said square portions perpendicular to the long sides of the rectangular shaped piece of material and further defining a second fold forward of and generally parallel to said first fold;

said right side portion and said left side portion of the long sides of the rectangular shaped piece of material and said short side from which said square portions of material have been removed each being folded at 90 degrees to a plane surface of the rectangular piece of material to form a left corner and a right corner, said left side portion and said short side being secured together along the length of edges of the sheet formed by one of the removed portions of the material to form said left corner, and said right side portion and said short side being secured together along the length of edges of the sheet formed by the opposite removed portion of the material to form said right corner;

first means for securing a portion of said pleat to said left side portion located forward of said left corner to secure said second fold against unfolding at said left corner;

second means for securing a portion of said pleat to said right side portion located forward of said right corner to secure said second fold against unfolding at said right corner, whereby a folded pleat is formed between said right corner and said left corner to provide space for a user's feet;

elastic material secured around said right corner and said left corner at the bottom edge thereof to retain the fitted sheet on a mattress on which said sheet is placed; and wherein said first means for securing a portion of said pleat and said second means for securing a portion of said pleat each comprise a generally vertical seam sewn to a respective side portion along said second fold forward of their respective said left corner and right corner.

4. A fitted top sheet for a bed for providing room for a user's feet, said sheet comprising a generally rectangular shaped piece of material having a portion of generally square configuration removed from opposite corners of a short side of the rectangular shaped piece of material, the sides of the square portions removed being slightly greater than the thickness of a mattress on which said sheet is to be used, wherein a right side portion and a left side portion are defined along long sides of the rectangular shaped piece of material;

a pleat formed in said rectangular shaped piece of material by folding a portion of the rectangular shaped material toward said short side having the square portions removed at the corners thereof, said folded material defining a first fold in generally adjacent alignment with the edges formed by the removal of said square portions perpendicular to the long sides of the rectangular shaped piece of material and further defining a second fold forward of and generally parallel to said first fold;

said right side portion and said left side portion of the long sides of the rectangular shaped piece of material and said short side from which said square portions of material have been removed each being folded at 90 degrees to a plane surface of the rectangular piece of material to form a left corner and a right corner, said left side portion and said short side being secured together along the length of edges of the sheet formed by one of the removed portions of the material to form said left corner, and said right side portion and said short side being secured together along the length of edges of the sheet formed by the opposite removed portion of the material to form said right corner;

first means for securing a portion of said pleat to said left side portion located forward of said left corner to secure said second fold against unfolding at said left corner;

second means for securing a portion of said pleat to said right side portion located forward of said right corner to secure said second fold against unfolding at said right corner, whereby a folded pleat is formed between said right corner and said left corner to provide space for a user's feet; and wherein said first means for securing a portion of said pleat and said second means for securing a portion of said pleat each comprise a generally vertical seam sewn to a respective side portion along said second fold forward of their respective said left corner and right corner.

* * * * *